US009078556B2

(12) United States Patent
Hering et al.

(10) Patent No.: US 9,078,556 B2
(45) Date of Patent: Jul. 14, 2015

(54) HOUSEHOLD APPLIANCE AND METHOD FOR OPERATING A HOUSEHOLD APPLIANCE

(75) Inventors: Reinhard Hering, Holzheim (DE); Michael Georg Rosenbauer, Reimlingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 95 days.

(21) Appl. No.: 13/498,335

(22) PCT Filed: Sep. 24, 2010

(86) PCT No.: PCT/EP2010/064094
§ 371 (c)(1), (2), (4) Date: Mar. 27, 2012

(87) PCT Pub. No.: WO2011/045160
PCT Pub. Date: Apr. 21, 2011

(65) Prior Publication Data
US 2012/0182152 A1 Jul. 19, 2012

(30) Foreign Application Priority Data
Oct. 12, 2009 (DE) ..... 10 2009 045 595

(51) Int. Cl.
*G08B 21/00* (2006.01)
*B08B 3/00* (2006.01)
*A47L 15/42* (2006.01)
*D06F 39/00* (2006.01)

(52) U.S. Cl.
CPC ..... *A47L 15/4293* (2013.01); *D06F 39/005* (2013.01)

(58) Field of Classification Search
CPC ... D06F 39/005; D06F 39/00; A47L 15/4293; G05B 2219/23119; G05B 2219/23137; G05B 2219/23175; G05B 2219/23316; G05B 2219/2633
See application file for complete search history.

(56) References Cited

U.S. PATENT DOCUMENTS 5,150,489 A * 9/1992 Kaji et al. ..... 8/159
5,760,493 A * 6/1998 Outcalt et al. ..... 307/38
5,789,868 A * 8/1998 Sears ..... 315/149
6,160,245 A 12/2000 Broker et al.
6,304,008 B1 * 10/2001 Goto et al. ..... 307/125
7,424,809 B2 * 9/2008 Son et al. ..... 68/12.27
(Continued)

FOREIGN PATENT DOCUMENTS

DE 4343105 A1 * 6/1995
DE 10329613 A1 1/2005
(Continued)

OTHER PUBLICATIONS

International Search Report PCT/EP2010/064094.
(Continued)

*Primary Examiner* — Firmin Backer
*Assistant Examiner* — Adnan Aziz
(74) *Attorney, Agent, or Firm* — James E. Howard; Andre Pallapies

(57) ABSTRACT

A household appliance, in particular a household dishwasher, includes an operating display unit having at least one visual and/or acoustic display, which is activated at least to display and/or signal a completion of a treatment cycle for a predefined time period on or after completion of the treatment cycle. The time period is hereby set by a delay element.

16 Claims, 2 Drawing Sheets

(56) References Cited

U.S. PATENT DOCUMENTS

| | | | | |
|---|---|---|---|---|
| 8,472,216 | B2 * | 6/2013 | Busch | 363/50 |
| 2004/0016265 | A1 * | 1/2004 | Bruntz et al. | 68/12.27 |
| 2004/0222824 | A1 * | 11/2004 | Engelmann et al. | 327/110 |
| 2005/0016228 | A1 * | 1/2005 | Bergemann et al. | 68/12.12 |
| 2005/0212652 | A1 * | 9/2005 | Ludenia | 340/3.71 |
| 2008/0127999 | A1 * | 6/2008 | Joerger et al. | 134/18 |
| 2009/0184584 | A1 * | 7/2009 | Hermann et al. | 307/80 |
| 2010/0090534 | A1 * | 4/2010 | Federmann et al. | 307/66 |
| 2010/0123357 | A1 * | 5/2010 | Federmann et al. | 307/112 |
| 2010/0262315 | A1 * | 10/2010 | Rosenbauer | 700/296 |
| 2011/0115306 | A1 * | 5/2011 | Rosenbauer | 307/116 |

FOREIGN PATENT DOCUMENTS

| | | | |
|---|---|---|---|
| EP | 2079090 | A1 * | 7/2009 |
| JP | 2006023813 | A * | 1/2006 |

OTHER PUBLICATIONS

Granting Decision RU 2012115537/12 dated Feb. 10, 2014.

* cited by examiner

HOUSEHOLD APPLIANCE AND METHOD FOR OPERATING A HOUSEHOLD APPLIANCE

BACKGROUND OF THE INVENTION

The invention relates to a household appliance, in particular a household dishwasher, at least having an operating display with at least one visual and/or acoustic display means, which is configured at least to display and/or signal a completed treatment cycle.

When consumer organizations rate household appliances, the energy consumption of the household appliance, in particular also its annual energy balance sheet, plays a significant role. Household appliances have an operating display with at least visual display means, for example LEDs, which can be used during the operation of the household appliance to display operating parameters, etc. and after completion of a treatment cycle according to a program to indicate that the treatment cycle has been completed. However after the end of the program the household appliance remains connected to the power supply network until the customer actively intervenes and deactivates the household appliance by actuating the main switch.

BRIEF SUMMARY OF THE INVENTION

The object of the invention is to provide a household appliance, in particular a household dishwasher, with which energy consumption is further reduced.

According to the invention provision is made for the display means displaying and/or signaling completion of the treatment cycle to be activated for a predefined time period on or after completion of the treatment cycle. The predefined time period can be a fixed value of finite size, which is stored for example in the appliance controller. However it can also be possible for a user for example to set the time period, in other words for it to be variable. In both instances the display of at least the completed treatment cycle is deactivated at the end of the time period. The display means can for example display and/or signal at least the completed treatment cycle or other information, such as the elapsed program time of a cleaning program, the type of cleaning program or interference during the program run. An elapsed treatment cycle can be displayed for example by displaying a corresponding symbol or an elapsed program run time. The invention is based on the knowledge that the energy consumption of the household appliance due to the electrical operation of the visual display means has a tangible effect on an annual energy balance sheet. Tests have shown that the time period between completion of the actual treatment cycle and a following treatment cycle can be in the region of hours or days. If the main switch is not deactivated after the end of the treatment cycle, in the prior art the visual display means in particular, which indicate the end of the program, then remain activated until the following treatment cycle. The energy consumption of the household appliance can thus be tangibly increased in the annual energy balance sheet. The invention allows the visual display means to be deactivated automatically, independently of actuation by a user of a main switch for example. Such deactivation of the display means can take place when its operation is classed as not necessary by a control device for example. Against this background according to the invention the energy consumption of the appliance after the end of a treatment cycle can be significantly reduced so that the overall energy consumption of the household appliance is correspondingly reduced.

A delay element is also preferably assigned to the controller, it being possible for said delay element to be used to set a time period, after which the controller deactivates the display means with a time delay in response to the deactivation signal. The delay element can be implemented technically for example as a microprocessor integrated in a control device. The delay element can be used to set the operating time of the visual display means in a variable manner after generation of the deactivation signal.

It is preferable for the delay element to be connected for signal transmission purposes to an input means, which a user can use to set the time period up to deactivation of the visual display means. The user is thus able to influence the operating behavior of the household appliance. The input means for setting the time delay can be provided directly in the control panel of the household appliance.

The time period can be set continuously or in steps using the input means. The time period can be set for example in a range between 0 and 60 mins.

In order to extend the selection options for the user when setting the input means of the delay element, the input means can be used to set a setting value, at which deactivation of the visual display means does not take place. The settable time period is then set to "infinite". The input means can also preferably be set to a further setting value, at which the time period is set to "0". The visual display means are then deactivated without further time delay immediately after the deactivation signal has been generated.

The deactivation signal to deactivate the visual display means can be generated immediately after a completed treatment cycle of the household appliance. The deactivation signal is preferably generated automatically by a control device, which can be used during a treatment cycle to actuate appliance components such as the display means or circulating/drain pumps for example.

The inventive controller can preferably deactivate a visual operating display of the household appliance which demonstrates high energy consumption even in standby mode. Alternatively the entire household appliance can be deactivated automatically by the controller.

Provision is also preferably made for the on switch and off switch to be connected in a parallel manner. The power supply network can be in contact for example with an on switch configured as a microswitch and the switching element connected parallel to this. When the household appliance is out of operation, both the on switch and the switching element are open. Actuation by pressing of the microswitch allows the deactivated, i.e. open, switching element of the self-holding contact circuit to be bridged, with the result that a voltage pulse is applied to the control device. The voltage pulse is directed by way of the control device to the self-holding contact circuit, with the result that the self-holding contact circuit closes the switching element. This allows current from the network to flow by way of the now closed switching element to the self-holding contact circuit so that the switching element remains closed in a stable manner, while the on switch is opened again. As soon as the control device directs the deactivation signal to the self-holding contact circuit, said circuit opens the switching element, causing the power supply into the household appliance to be interrupted.

Provision is preferably made here for an equally high electrical voltage to be present at the on switch and the off switch. This allows a particularly simple structure.

Provision is preferably made here for the on switch and the off switch to be connected to the control device in such a manner that an activation and/or deactivation pulse is transmitted. Provision is preferably also made for the power supply unit to be disposed in such a manner that it forms a series circuit with the on switch and the off switch. Provision is also preferably made for the control device to be connected to the power supply unit in such a manner that it can be supplied with electrical energy. Provision is furthermore preferably made for the operating display to be connected to the power supply unit in such a manner that it can be provided with electrical energy. Finally provision is preferably made for the self-holding contact circuit to be assigned to a controller that can be actuated by the control device.

The self-holding contact circuit can preferably have a bistable relay, to which a relay contact acting as a switching element can be connected. Such a bistable relay is primarily characterized by the attribute that in the power-free state it can adopt two different stable switching states. A relay contact of the bistable relay can be connected as the switching element in the main supply line of the household appliance. When the deactivation signal is applied to the bistable relay, it switches the relay contact from a stable power-free open state to a stable power-free closed state or vice versa, with the result that the household appliance is decoupled completely from the network or connected to it. A flipflop, in particular an RS flipflop, can be used instead of a relay.

Finally provision is preferably made for the self-holding contact circuit to be connected to the off switch in such a manner that the off switch can be switched to an open state so that isolation from the supply voltage is possible in a simple manner.

The object of the invention is further achieved by a method as claimed in claim 8. Advantageous developments are set out in the subclaims.

BRIEF DESCRIPTION OF THE DRAWINGS

An exemplary embodiment of the invention is described in more detail below with reference to the accompanying figures, in which.

DETAILED DESCRIPTION OF EXEMPLARY EMBODIMENTS OF THE PRESENT INVENTION

Figure 1:
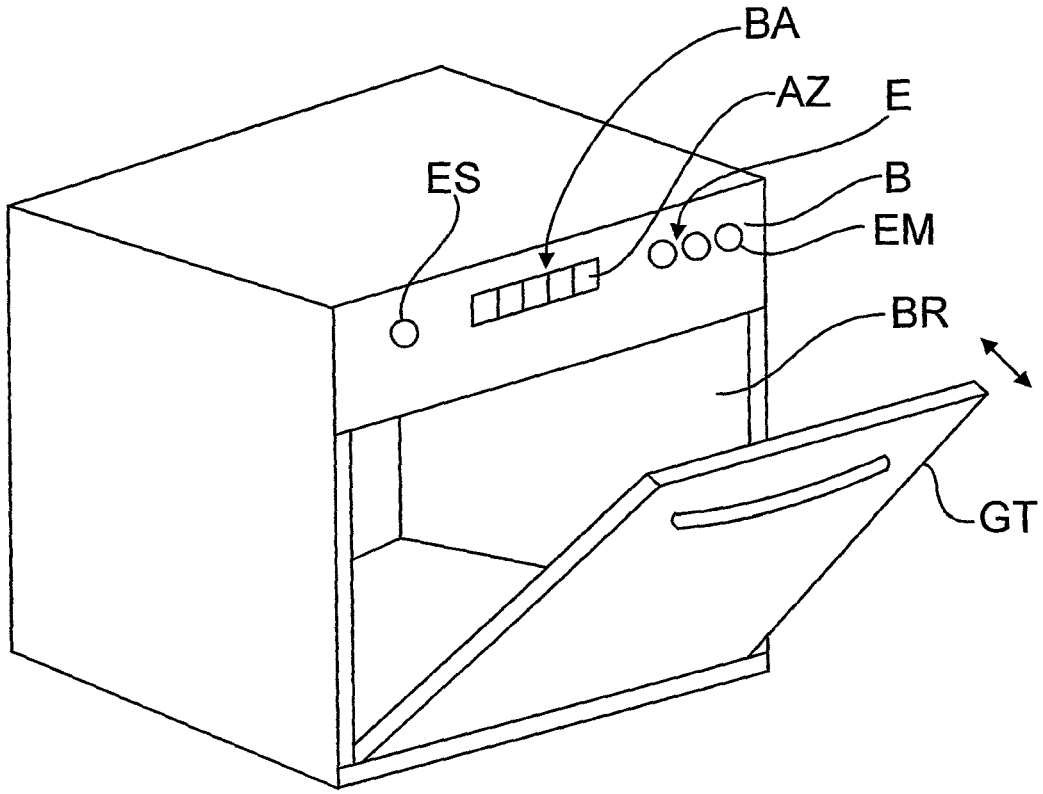
FIG. 1 shows a schematic perspective view of a household dishwasher.

FIG. 1 shows an exemplary embodiment of a household appliance in the form of a household dishwasher with a front appliance door GT, which can be pivoted in the known manner about a horizontal pivot axis at the bottom and with which a loading opening of the wash compartment BR can be opened for loading and/or unloading or closed. The loading opening is bounded at the top by a control panel B, which holds a microswitch ES and (simply indicated) visual display means AZ of an operating display BA. Input means E are also provided, which can be used to input operating parameters for a wash cycle of the household dishwasher, as are input means EM, which can be used to set a delay element VG, described below with reference to FIG. 2.

The microswitch ES provided in the left region of the control panel B in FIG. 1 is configured here as a pushbutton switch for example. Actuation by pressing of the microswitch ES allows the household dishwasher to be switched to operation readiness, while subsequent actuation by pressing decouples the household dishwasher from the power supply network.

Figure 2:
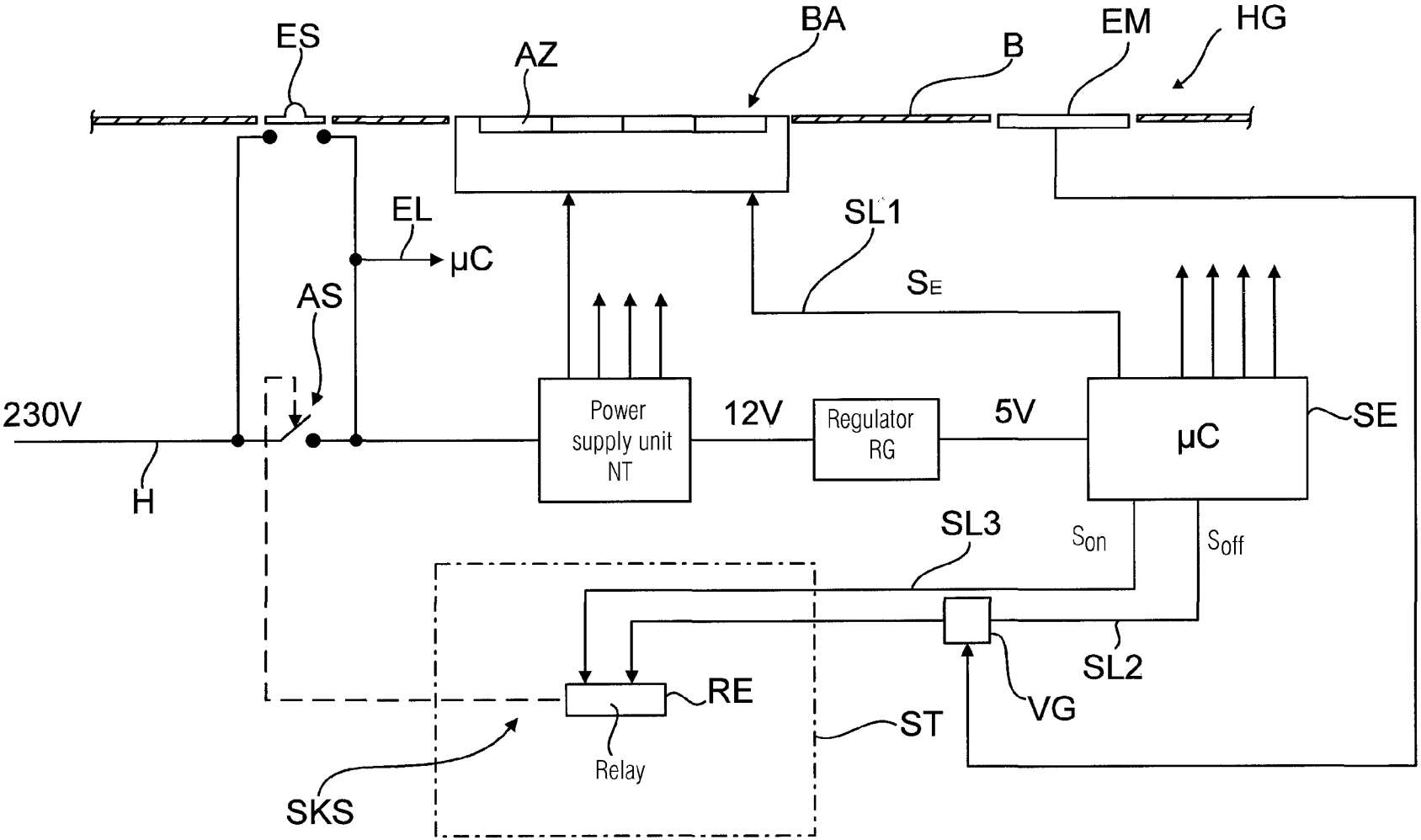
FIG. 2 shows a circuit arrangement of the household dishwasher.

FIG. 2 shows a circuit arrangement, in which the microswitch ES and the operating display BA by way of example are integrated. In the circuit arrangement shown the household dishwasher is connected by way of a main supply line H to the power supply network. Connected in series in the main supply line H are a switching element AS (described below) and a power supply unit NT.

The power supply unit NT converts the network voltage of for example 230 V to a low voltage of 12 V. The low voltage 12V is converted by means of a regulator RG connected in series downstream of the power supply unit NT to a low voltage of 5 V, which is supplied to a control device SE. The power supply unit NT also supplies other appliance components and also the operating display BA of the household dishwasher with low voltage by way of additional outputs.

The control device SE is integrated in a control module (not shown in detail) and during the execution of a wash program actuates the visual display means AZ of the operating display BA and further appliance components, for example the drain pump or the circulating pump, by means of control signals $S_E$ by way of a first signal line SL1.

As also shown in FIG. 2, the control device SE is connected by way of a second signal line SL2 to a bistable relay RE of a self-holding contact circuit SKS. The abovementioned switching element AS, which is connected in the main supply line H instead of a mechanical main switch and as such takes on a main switch function, which can be used to decouple the household dishwasher from the power supply network or connect it to it, is assigned to the bistable relay RE as a relay contact. A delay element VG is connected in the second signal line SL2. The delay element VG can be used to forward a deactivation signal $S_{off}$, generated by the control device SE and described below, to the relay RE with a time delay.

The delay element VG can be actuated using the input means EM held by the control panel B according to FIG. 2. The input means EM can be used to set a time period Δt, at the end of which the deactivation signal $S_{off}$ is forwarded to the relay RE.

Depending on the time period Δt set by the input means EM, the deactivation signal $S_{off}$ generated in the control device SE is forwarded by the delay element VG to the relay RE with a time delay. By setting this time period Δt, the user can determine how long the visual display means AZ are to remain activated after the end of the program.

If the time period Δt is set to 0, the deactivation signal $S_{off}$ is forwarded to the relay RE without delay. This means that the user dispenses completely with a visual program end display after completion of the wash cycle. If however the time period Δt is set to "infinite", the relay RE and therefore also the visual display means AZ remain permanently activated after the program end of the wash cycle. In this instance the user dispenses with automatic deactivation of the household dishwasher after completion of the wash cycle.

When the household dishwasher is out of operation both the microswitch ES and the switching element AS are open. The deactivated household dishwasher is brought into operation by actuation by pressing of the microswitch ES, causing the initially still open switching element AS to be bridged. The actuation by pressing of the microswitch ES causes a voltage pulse to be supplied, which is directed by way of the power supply unit NT and by way of the regulator RG to the control device SE.

The control device SE then forwards an activation signal $S_{on}$ by way of a third signal line SL3 to the bistable relay RE causing its relay coil to attract and the switching element AS to be switched from the power-free stable open state to a power-free stable closed state. This causes the microswitch ES, which after actuation by pressing is again open, to be bridged by the now closed switching element AS, with the result that the network voltage is present at the power supply unit NT.

The household dishwasher is therefore switched to operation readiness so that a wash program can then be started by means of the input means E. After the end of the wash cycle, the control device SE deactivates the appliance components, for example the drain pump or circulating pump.

Immediately after completion of the wash program the control device SE also generates a further voltage pulse, which as a deactivation signal $S_{off}$ by way of the second signal line SL2 actuates the bistable relay RE. The relay RE then switches the switching element AS from the closed position to the open position, with the result that the household dishwasher is completely isolated from the power supply network.

The switching element AS of the relay RE therefore operates as a main switch which automatically isolates the power supply unit NT of the household dishwasher from the power supply network after the end of the wash program. This means that after the end of the program a supply of power by way of the power supply unit NT to the visual display means AZ of the operating display BA in particular is also interrupted.

As also shown in FIG. 2, the microswitch ES is connected directly to the control device SE for signal transmission purposes by way of an input line EL. The voltage pulse supplied when the microswitch ES is actuated manually by pressing is therefore directed directly to the control device SE, which detects and analyzes the pulse.

On detection of such a voltage pulse the control device SE checks whether the power supply unit NT is already activated when the microswitch ES is activated by pressing. If the power supply unit NT is not yet activated, the control device SE identifies activation actuation by the user and uses the activation signal $S_{on}$, as described above, to actuate the relay RE. If the power supply unit NT is already activated, the control device SE identifies a deactivation actuation by the user from the actuation by pressing of the microswitch, so the control device SE directs a corresponding deactivation signal $S_{off}$ to the relay RE. The household dishwasher is then taken out of operation. Any ongoing wash program is therefore interrupted.

LIST OF REFERENCE CHARACTERS

ES Microswitch
AS Switching element
H Main supply line
B Control panel
AZ Display means
BA Operating display
EL Input line
RG Regulator
SE Control device
RE Bistable relay
SKS Self-holding contact circuit
ST Controller
HG Household appliance
SL1, SL2, SL3 Signal lines
VG Delay element
BR Treatment compartment
Δt Delay time

The invention claimed is:

1. A household appliance, comprising:

an operating display unit having at least one visual display and/or acoustic indicator, configured to be activated on or after completion of a treatment cycle at least to display and/or signal completion of the treatment cycle;

a main supply line, wherein a switching element and a power supply unit are connected in series on the main supply line, said power supply unit being configured to supply low voltage power to at least the operating display unit, and said switching element being configured to isolate the power supply unit from an external power supply network; and a delay element configured to:

1) cause the at least one visual display and/or acoustic indicator to be activated for a predefined time period, and 2) upon completion of the predefined time period, cause a supply of power from the external power supply network to the operating display unit to be interrupted by isolating the power supply unit from the external power supply network via the switching element, wherein the delay element is configured to receive a deactivation signal and forward the deactivation signal to an actuating device to cause the appliance to be decoupled from the external power supply network by the switching element, and wherein the delay element forwards the deactivation signal after the predefined time period, and wherein the actuating device is a bistable relay having a relay contact arranged to be connected as the switching element on the main supply line.

2. The household appliance of claim 1, constructed in the form of a household dishwasher.

3. The household appliance of claim 1, further comprising an input member connected to the delay element for signal transmission and configured to enable a user to set the time period.

4. The household appliance of claim 3, wherein the input member is configured for setting to a setting value, at which deactivation of the display is prevented.

5. The household appliance of claim 3, wherein the input member is configured for setting a further setting value, at which the time period is set to 0.

6. The household appliance of claim 1, further comprising a controller to generate the deactivation signal in response to the completion of the treatment cycle to deactivate the display and/or indicator with a time delay.

7. The household appliance of claim 6, wherein the controller is configured to deactivate the operating display unit and the household appliance.

8. The household appliance of claim 1, further comprising a microswitch which when actuated is configured to bridge the switching element when the switching element is positioned to isolate the power supply unit from the external power supply network.

9. A method for operating a household appliance, comprising:

displaying and/or signaling at least a completion of a treatment cycle using an operating display unit with at least one visual display and/or acoustic indicator;

maintaining the display and/or indicator in an activated state for a predefined time period after completion of the treatment cycle, wherein a switching element and a power supply unit are connected in series on a main supply line, said power supply unit being configured to supply low voltage power to at least the operating display unit, and said switching element being configured to isolate the power supply unit from an external power supply network;

upon completion of the predefined time period, causing a supply of power from the external power supply network to the operating display unit to be interrupted by isolating the power supply unit from the external power supply network via the switching element;

setting the time period by a delay element; and receiving a deactivation signal with the delay element and forwarding the deactivation signal to an actuating device after the predefined time period, said deactivation signal for decoupling the appliance from the external power supply network by causing the switching element to open, wherein the actuating device is a bistable relay having a relay contact arranged to be connected as the switching element on the main supply line.

10. The method of claim 9 for operating a household dishwasher.

11. The method of claim 9, wherein the time period is set by a user by actuating an input member connected to the delay element for signal transmission.

12. The method of claim 11, further comprising setting the input member to a setting value, at which the display remains activated.

13. The method of claim 11, further comprising setting the input member to a further setting value, at which the time period is set to 0.

14. The method of claim 9, further comprising generating the deactivation signal by a controller in response to the completion of a treatment cycle to deactivate the display and/or indicator with a time delay.

15. The method of claim 14, wherein the controller deactivates the operating display unit or the household appliance.

16. The method of claim 9, further comprising actuating a microswitch to bridge the switching element when the switching element is positioned to isolate the power supply unit from the external power supply network.

* * * * *